US008100720B2

(12) United States Patent
Lin et al.

(10) Patent No.: US 8,100,720 B2
(45) Date of Patent: Jan. 24, 2012

(54) ELECTRICAL CONNECTOR FEATURED WITH USB/ESATA INTERFACES

(75) Inventors: Chih-Nan Lin, Tu-Cheng (TW); Kuo-Chun Hsu, Tu-Cheng (TW); Hung-Chi Yu, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/763,227

(22) Filed: Apr. 20, 2010

(65) Prior Publication Data

US 2010/0267262 A1 Oct. 21, 2010

(30) Foreign Application Priority Data

Apr. 20, 2009 (TW) ..... 98113004 A

(51) Int. Cl.
*H01R 13/648* (2006.01)

(52) U.S. Cl. ..... 439/607.34

(58) Field of Classification Search ..... 439/660, 439/218, 607.34, 607.35, 607.11, 607.05, 439/733.1

See application file for complete search history.

(56) References Cited

U.S. PATENT DOCUMENTS

| | | | | |
|---|---|---|---|---|
| 6,464,521 | B1 * | 10/2002 | Kurotori et al. | 439/260 |
| 7,097,507 | B1 * | 8/2006 | Zhang et al. | 439/607.35 |
| 7,371,116 | B2 * | 5/2008 | Chiang | 439/607.34 |
| 2009/0305551 | A1 * | 12/2009 | Kameda | 439/497 |

* cited by examiner

*Primary Examiner* — Alexander Gilman

(74) *Attorney, Agent, or Firm* — Andrew C. Cheng; Wei Te Chung; Ming Chieh Chang

(57) ABSTRACT

An electrical connector includes an insulative housing defining a mating cavity, a tongue portion forwards extending into the mating cavity and defining thereon first and second faces opposite to each other, and first and second sets of contacts retained to the housing. The first set of contacts includes pairs of differential pairs and grounding contacts arranged at opposite sides of the differential pairs, and each of the differential pairs defines a first contacting section disposed in the first face and a soldering section. The second set of contacts each defines a deflectable cantilevered beam accessible from the second face. At least one of the grounding contacts defines a main section retained in the tongue portion and further extending into the mating cavity along the tongue portion, and the main section is disposed in a plane perpendicular to the first face.

16 Claims, 4 Drawing Sheets

ELECTRICAL CONNECTOR FEATURED WITH USB/ESATA INTERFACES

CROSS-REFERENCE TO RELATED APPLICATIONS

This application is related to U.S. patent application Ser. No. 12/702,293, filed on Feb. 9, 2010 and entitled "ELECTRICAL CONNECTOR FEATURED USB/eSATA INTERFACES INCORPORATED WITH ADDITIONAL POWER CONTACT" which has the same assignee as the present invention

BACKGROUND OF THE INVENTION

1. Field of the Invention

The present invention relates to an electrical connector, and more particularly to an electrical connector compatible to standards of Universal Serial Bus (USB) and External Serial Advanced Technology Attachment (eSATA) protocols having a grounding contact which is disposed between two pairs of differential pairs and perpendicular to the differential pairs to improve the cross-talk between the two pairs of differential pairs.

2. Description of the Related Art

U.S. Pat. No. 7,371,116 issued to Chiang on May 13, 2008 discloses a connector socket compatible to external serial ATA (eSATA) and universal serial bus (USB) connectors has a casing, an eSATA contact set and a USB contact set. The casing has a cavity defined in the casing, an inner rear surface and a contact seat formed on and extending forward from the inner rear surface. The eSATA contact set is mounted on the contact seat and has multiple eSATA contacts being conductive and mounted on the contact seat. The USB contact set is mounted on the contact seat opposite to the eSATA contact set and has multiple USB contacts mounted thereon the contact seat. The eSATA contact set includes two pairs of differential pairs for signal transmission and three grounding pieces with the differential pair arranged alternatively therebetween. It can be readily seen from the disclosure of the Chiang '116 patent that the contacting portions of the eSATA contacts are located in the same plane, and the contacting portions of the grounding pieces are disposed at opposite sides of the contacting portions of the differential pairs to reduce the cross-talk in the connector.

In addition, cross-talk is a concern in designing an high performance connector. Therefore, an improved electrical connector having lower cross-talk is highly desired.

SUMMARY OF THE INVENTION

An object of the present invention is to provide an electrical connector compatible to both standards of Universal Serial Bus (USB) and External Serial Advanced Technology Attachment (eSATA) protocols and having low cross-talk by providing an interface in which the contact terminals are configured into USB and eSATA interfaces within the single port.

In order to achieve the above-mentioned object, an electrical connector includes an insulative housing defining a mating cavity, a tongue portion forwards extending into the mating cavity and defining thereon first and second faces opposite to each other, and first and second sets of contacts retained to the housing. The first set of contacts includes pairs of differential pairs and grounding contacts arranged at opposite sides of the differential pairs, and each of the differential pairs defines a first contacting section disposed in the first face and a soldering section. The second set of contacts each defines a deflectable cantilevered beam accessible from the second face. At least one of the grounding contacts defines a main section retained in the tongue portion and further extending into the mating cavity along the tongue portion, and the main section is disposed in a plane perpendicular to the first face.

Other objects, advantages and novel features of the invention will become more apparent from the following detailed description of the present embodiment when taken in conjunction with the accompanying drawings.

DETAILED DESCRIPTION OF THE INVENTION

Figure 1:
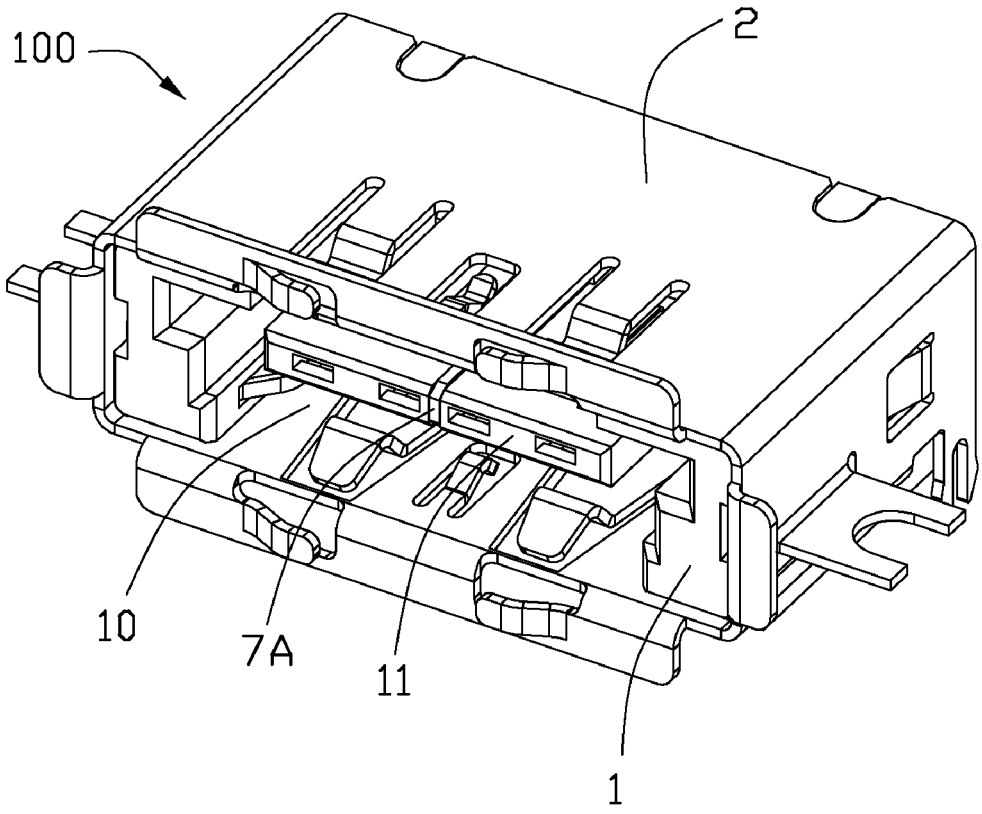
FIG. 1 is an assembled, perspective view of an electrical connector in accordance with the present invention.

Reference will now be made to the drawing figures to describe the preferred embodiments of the present invention in detail.

Figure 2:
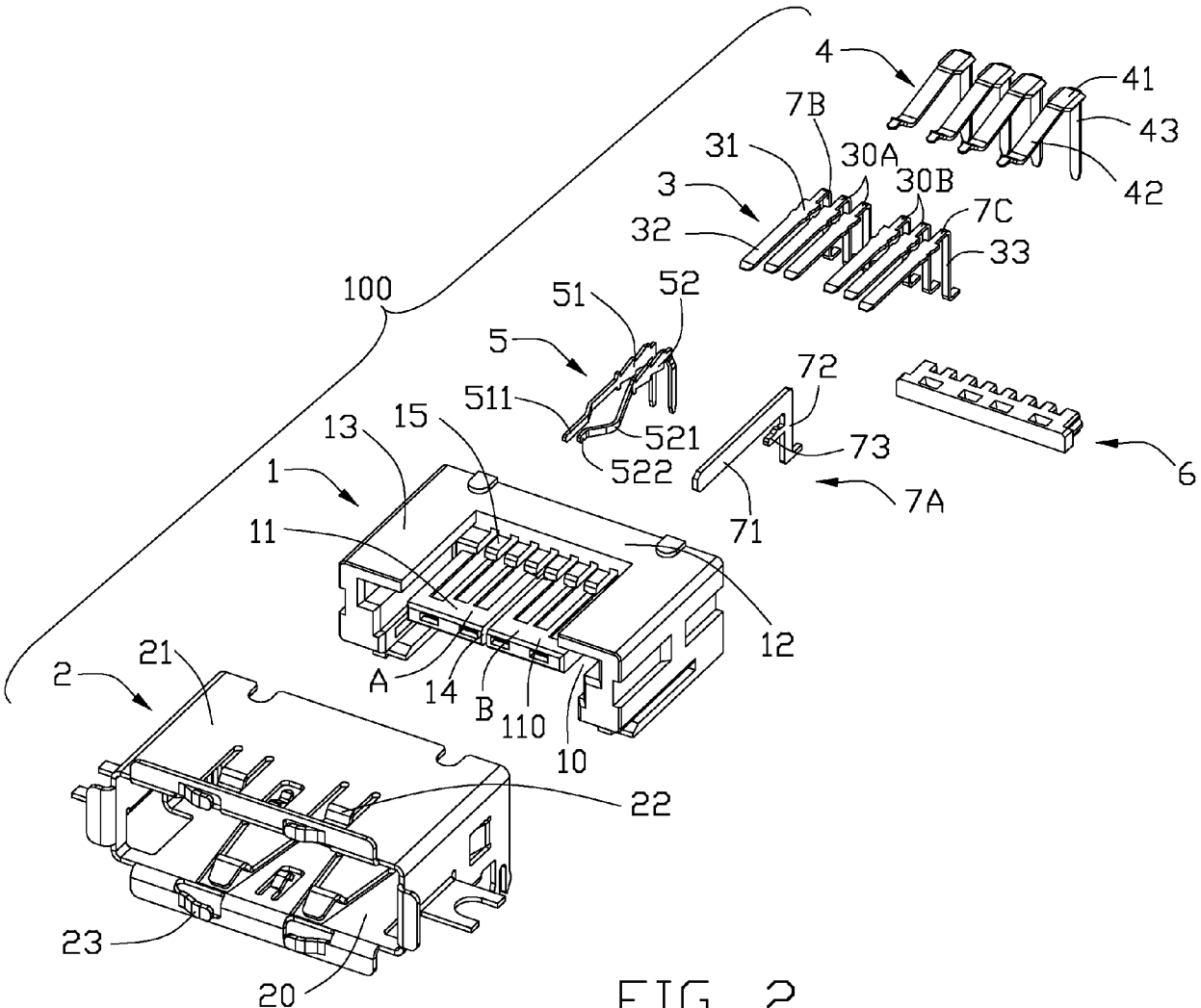
FIG. 2 is an exploded perspective view of the electrical connector shown in FIG. 1.

Referring to FIG. 1 and FIG. 2, disclosed here is an electrical connector 100 made in accordance with the present invention. The electrical connector 100, compatible to standards of Universal Serial Bus (USB) and External Serial Advanced Technology Attachment (eSATA) protocols, includes an insulative housing 1, a shielding shell 2 surrounding the housing 1 and sets contact retained to the housing 1.

Figure 3:
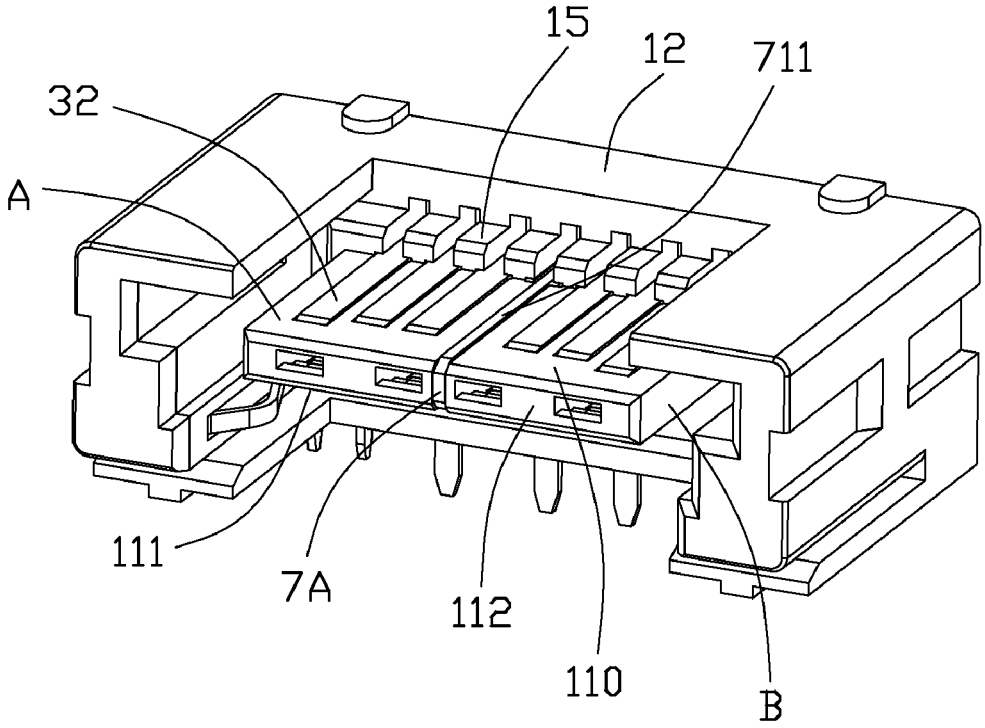
FIG. 3 is a perspective view of the electrical connector shown in FIG. 1 with the shell removed.

Referring to FIG. 2 and FIG. 3, the housing 1 defines a base portion 12, a pair of sidewalls 13 respectively extending forwards from two opposite ends of the base portion 12 and a mating cavity 10 defined by the pair of sidewalls 13 and the base portion 12 commonly. The mating cavity 10 runs through a front end of the housing 1. A mating tongue portion 11, spaced away from said opposite sidewalls 13, extends forwards from the base portion 12 and into the mating cavity 10 along a mating direction, and the tongue portion 11 has an upper/first face 110 and a lower/second face 111 opposite to each other for contacts' arrangement. A stand-off portion 15 is formed at a joint of the upper face 110 of the tongue portion 11 and the base portion 12 to increase the rigidity of the tongue portion 11.

The contacts grouped into a first set of contacts 3, totally seven eSATA contacts are included for connecting with a complementary connector/an eSATA plug (not shown), a second set of contacts 4, totally four USB contacts are included for connecting with a complementary connector/a USB plug (not shown), and a detecting pairs 5. The first set of contacts 3 includes two pairs of differential pairs 30A, 30B for signal transmission and three grounding contacts 7A, 7B and 7C located at two opposite sides of the differential pairs 30A, 30B. The first grounding contact 7A is arranged between the two pairs of adjacent differential pair 30A, 30B, and the first differential pairs 30A is arranged between the first and second grounding contacts 7A, 7B, the second differential pairs 30B is arranged between the first and third grounding contacts 7A, 7C. The first set of contacts 3 is defined as an eSATA contact set, and the second set of contacts 4 is defined as a USB contact set.

Figure 4:
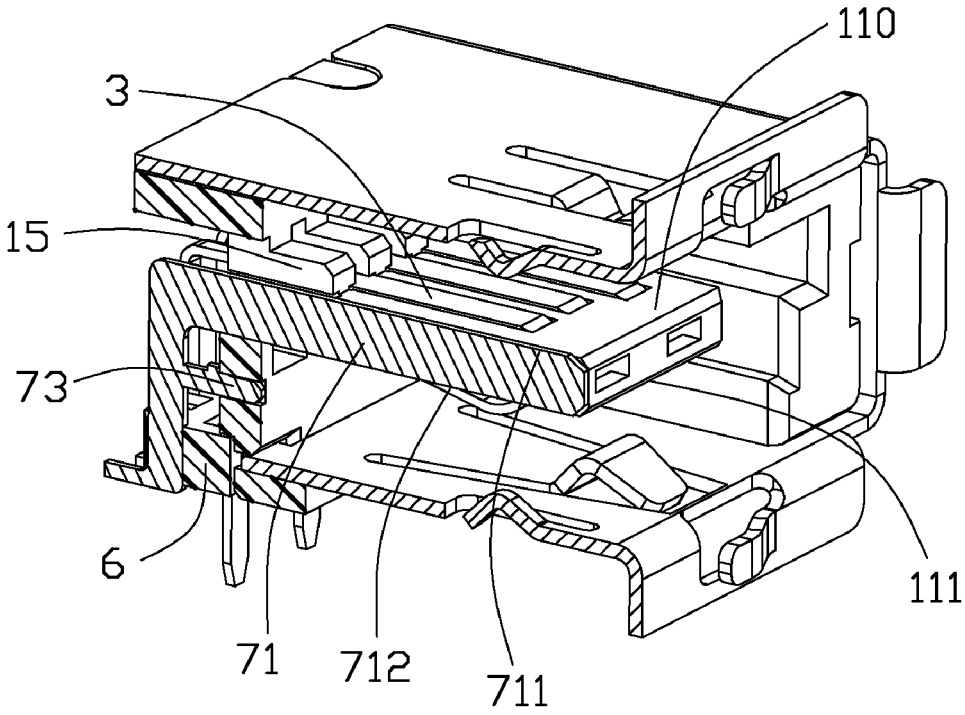
FIG. 4 is a cross sectional view of FIG. 1, showing the configuration of the grounding contact.

Referring to FIG. 2 to FIG. 4, the second and third grounding contacts 7B, 7C disposed at two outmost sides of the first set of contacts 3 and the differential pairs 30A, 30B have similar configuration and each includes a retention section 31 retained in the base portion 12, a first blade contacting section 32 extending forward from the retention section 31 and a leg section 33 bending downwards from the retention section 31. The first contacting sections 32 are disposed in the upper face 110 of the tongue portion 11, and the soldering sections 33 extend out of the base portion 12 to connect with a printed circuit board. The first grounding contact 7 has different configuration from the differential pairs 30A, 30B and defines a main section 71, a leg section 72 extending downwards from a rear portion of the main section 71 and a retention section 73 extending forwards from a front edge of the leg section 72, and a free end of the leg section 72 is served as a soldering portion.

The second set of contacts 4 each includes a retention section 41 retained in the base portion 12, a deflectable cantilevered beam 42 forwards extending from the retention section 41 into the mating cavity 10, and a leg section 43 bending downwards from the retention section 41. The deflectable cantilevered beam 42 is accessible from the lower face 111 of the tongue portion 11. The cantilevered beams 42 are designated as USB 2.0 contacting sections.

The housing 1 defines a receiving slot 14 recessed forwards from a rear face of the base portion 12 and further running through the first and second faces 110, 111 and a front face 112 of the tongue portion 11 thereof. The receiving slot 14 is provided at a middle portion of the tongue portion 11 to divide the tongue portion 11 into a first tongue A and a second tongue B. The tongue portion 11 is provided by the first and second tongues A, B arranged in a side-by-side manner. After retained the contacts in the insulating housing 1, the first contacting sections 32 are disposed in the first face 110 along a traverse direction perpendicular to the mating direction of the connector 100, and the first grounding contact 7A is retained to the housing 1 with the retention section 73 having barbs at lateral sides thereof fixed in the base portion 12. The main section 71 is received in the receiving slot 14 and sandwiched by the first and second tongues A, B, and an upper edge 711 of the main section 71 extends upwards and further exposed onto the first face 110 of the tongue portion 11, and a lower edge 712 of the main section 71 extends downwards and further exposed onto the second face 111 of the tongue portion 11. The main section 71 of the first grounding contact 7A is disposed in a plane perpendicular to the first face 110. The main section 71 which is perpendicular to the first contacting sections 32 of the differential pairs 30A, 30B can reduce the cross-talk between the two pairs of the differential pairs, which can provide an electrical connector 100 having low cross-talk.

The detecting pairs 5 is retained to the sidewall 13 and includes a contacting pin 51 and a movable pin 52. The movable pin 52 defines a projecting portion 521 projecting into the mating cavity 10 and a contacting portion 522 disposed at a free end of the projecting portion and further extending into the sidewall 13. The contacting pin 51 defines an abutting portion 511 facing to the contacting portion 522. The contacting portion 522 may move to contact the abutting portion 511 when the projecting portion 521 is driven by the USB plug inserted into the mating cavity 10. The shell 2 surrounds the housing 1 and defines an elastic piece 22 stamped from a top piece 21 and entering into the mating cavity 10 to latch the complementary connectors. The top piece 21 and a bottom piece 20 opposite to the top piece 21 each further defines an abutting piece 23 projecting forwards to contact with peripheral equipment. The leg sections 33, 43 and 72 run through a retaining member 6 to connect with the printed circuit board.

In other embodiments, the second and third grounding contacts 7B, 7C also can be provided with the identical configuration as the first grounding contact 7A, and all the main sections of the grounding contacts can be set perpendicular to the contacting sections 32, which can improve the cross-talk between the differential pairs effectively.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing defining a mating cavity;

a tongue portion forwards extending into the mating cavity and defining thereon first and second faces opposite to each other;

a first set of contacts including two pairs of differential pairs and three grounding contacts with each of the differential pairs arranged between two adjacent grounding contacts, and each of the differential pairs defining a first contacting section disposed in the first face and a soldering section;

a second set of contacts each defining a deflectable cantilevered beam accessible from the second face; wherein the three grounding contacts includes a first grounding contact having a main section retained in the tongue portion and further extending into the mating cavity along the tongue portion to locate between the two differential pairs, and second and third grounding contacts providing two blade contacting sections respectively located at two outer sides of the two differential pairs, and the main section of the first grounding contact is disposed in a plane perpendicular to the first face, and the contacting sections of the second and third grounding contacts each is disposed in a plane parallel to the first face.

2. The electrical connector as described in claim 1, wherein the tongue portion defines a receiving slot running through the first face thereof, and the first grounding contact is received in the receiving slot with an upper edge of the main portion exposed onto the first face and arranged between the two pairs of adjacent differential pairs.

3. The electrical connector as described in claim 2, wherein the main section of the first grounding contact is perpendicular to the first contacting sections of the differential pairs.

4. The electrical connector as described in claim 3, wherein the receiving slot further runs through the second face of the tongue portion, and a lower edge of the main section is exposed onto the second face of the tongue portion.

5. The electrical connector as described in claim 4, wherein the first grounding contact defines a leg section extending downwards from a rear portion of the main section and a retention section extending forwards from a front edge of the leg section, and a free end of the leg section is defined as a soldering portion.

6. The electrical connector as claimed in claim 1, wherein a thickness of said first grounding contact is perpendicular to that of the contacting sections of the second and third grounding contacts.

7. An electrical connector compatible to standards of Universal Serial Bus (USB) and External Serial Advanced Technology Attachment (eSATA) protocols, comprising:

an insulative housing defining a base portion, a pair of sidewalls respectively extending forwards from two opposite ends of the base portion and a tongue portion disposed between the sidewalls and defining thereon first and second faces opposite to each other and a front face connecting with the first and second faces, and a receiving slot running through the first face, the second face and the whole front face to divide the tongue portion into first and second tongues separated from each other and arranged in a side-by-side manner; and an eSATA contact set comprising two pairs of differential pairs respectively retained to the first and second tongues and a first grounding contact defining a main section received in the receiving slot with an upper edge exposed onto the first face, a lower edge exposed onto the second face, and a front edge exposed onto the whole front face and sandwiched by the separated first and second tongues, each of the differential pairs defining a first blade contacting section disposed in the first face and the main section disposed in a plane perpendicular to the first face.

8. The electrical connector as described in claim 7, further defining a USB contact set comprising several contacts each defining a deflectable cantilevered beam accessible from the second face.

9. The electrical connector as described in claim 8, wherein the upper edge of the main portion is arranged between the two pairs of differential pairs.

10. The electrical connector as described in claim 9, wherein the main section of the first grounding contact is perpendicular to the first contacting sections of the differential pairs.

11. The electrical connector as described in claim 7, wherein second and third grounding contacts are respectively disposed at two outmost sides of the eSATA contact set, and the second and third grounding contacts each defines a contacting section disposed in a plane parallel to the first face.

12. The electrical connector as claimed in claim 11, wherein a thickness of said first grounding contact is perpendicular to that of the contacting sections of the second and third grounding contacts.

13. An electrical connector comprising:

an insulative housing defining a mating port with therein a forwardly extending mating tongue defining opposite first and second faces thereon;

a plurality of first contacts disposed in the housing, each of said first contacts defining a stiff contacting section exposed upon the first face;

a plurality of second contacts disposed in the housing, each of said second contacts defining a resilient contacting section exposed upon the second face;

a center grounding contact disposed in the housing and defining a contacting section located at a center line of the mating tongue with a first edge section exposed to the first face to electrically segregate two differential pairs of said first contacts respectively located by two sides thereof, and with a second edge section exposed to the second face to electrically segregate two signal contacts of the second contacts respectively located by two sides thereof; wherein the first contacts further have two outer grounding contacts respectively located by outer sides of said two differential pairs and cooperate with said center grounding contact to electrically segregate the corresponding differential pair therebetween, the contacting section of the center grounding contact is disposed in a plane perpendicular to the first face and the two outer grounding contacts each defines a contacting section disposed in a plane parallel to the first face.

14. The electrical connector as claimed in claim 13, wherein the second contacts further have two non-signal contacts respectively located by outer sides of said two signal contacts and cooperate with the center grounding contact to electrically segregate the corresponding signal contact.

15. The electrical connector as claimed in claim 13, wherein a thickness of said center grounding contact is perpendicular to that of the stiff contacting sections of the first contacts and that of the contacting sections of the two outer grounding contacts.

16. The electrical connector as claimed in claim 13, wherein said center grounding contact essentially divides said mating tongue into halves completely.

* * * * *